United States Patent [19]

Moser et al.

[11] Patent Number: 4,883,135

[45] Date of Patent: Nov. 28, 1989

[54] APPARATUS FOR ROCK DRILL

[75] Inventors: Bernhard Moser, Altshausen; Wolfang Peetz, Blitzenreute; Hermann Hugger, Altshausen, all of Fed. Rep. of Germany

[73] Assignee: Hawera Probst GmbH & Co., Ravensberg, Fed. Rep. of Germany

[21] Appl. No.: 235,936

[22] Filed: Aug. 24, 1988

[30] Foreign Application Priority Data

| | | | |
|---|---|---|---|
| Sep. 18, 1987 | [DE] | Fed. Rep. of Germany | 8712650[U] |
| Oct. 19, 1987 | [DE] | Fed. Rep. of Germany | 3735316 |
| Dec. 1, 1987 | [DE] | Fed. Rep. of Germany | 3740692 |

[51] Int. Cl.[4] ..... E21B 17/22

[52] U.S. Cl. ..... 175/323; 175/394; 408/230

[58] Field of Search ..... 175/323, 394; 408/210, 408/230

[56] References Cited

U.S. PATENT DOCUMENTS

| | | | |
|---|---|---|---|
| 1,209,058 | 12/1916 | Smith | 175/394 |
| 2,322,894 | 6/1943 | Stevens | 408/230 |
| 2,728,558 | 12/1955 | Tengberg . | |
| 3,011,367 | 12/1961 | Tilden | 76/108 |
| 3,147,646 | 9/1964 | Rawcliffe | 77/65 |
| 3,360,960 | 1/1968 | Massey . | |
| 3,485,052 | 12/1969 | Turzillo | 175/394 X |
| 4,143,723 | 3/1979 | Schmotzer | 175/394 X |
| 4,507,028 | 3/1985 | Matsushita | 408/230 |

FOREIGN PATENT DOCUMENTS

| | | | |
|---|---|---|---|
| 0126409 | 7/1985 | European Pat. Off. . | |
| 0226537 | 6/1987 | European Pat. Off. . | |
| 0201724 | 9/1987 | European Pat. Off. . | |
| 832379 | 2/1952 | Fed. Rep. of Germany . | |
| 1602003 | 3/1971 | Fed. Rep. of Germany . | |
| GM6933778 | 10/1971 | Fed. Rep. of Germany . | |
| 2350985 | 4/1975 | Fed. Rep. of Germany . | |
| GM8025800 | 2/1981 | Fed. Rep. of Germany . | |
| 3020284 | 12/1981 | Fed. Rep. of Germany . | |
| 94211 | 5/1985 | Japan | 408/230 |
| 891250 | 12/1981 | U.S.S.R. | 408/230 |

OTHER PUBLICATIONS

DIN20377, 7-1979.
DIN488, 6-1986, Teil 2.
DIN488, 6-1986, Teil 3.

*Primary Examiner*—Hoang C. Dang
*Attorney, Agent, or Firm*—Spencer & Frank

[57] ABSTRACT

A rock drill for rotary and percussive stressing exhibits equally good or improved transport characteristics of driling dust for a smaller transport groove as compared with prior rock drills. In order to achieve this, a main transport groove having longitudinal profiles is formed, with an interrupted secondary transport groove integrated in the main transport groove, the transport ribs of which exhibit a greater angle of twist than the angle of twist of the main transport groove.

19 Claims, 2 Drawing Sheets

APPARATUS FOR ROCK DRILL

BACKGROUND OF THE INVENTION

The invention relates to a rock drill having a drill head fitted with a hard metal cutting edge, a chucking shank, and at least on transport coil of spiral-shaped construction.

The spiral-shaped transport coils of rock drills are produced by cutting or noncutting treatment in order to produce chip grooves in the generally cylindrical initial material.

In rock drills the transport coil has the main function of transporting the material detached by the hard metal cutting edge, that is to say the drilling dust or drillings, out of the drill hole. The size of the drilling dust groove, that is to say the clear transport cross-section, is then a decisive factor in the efficiency of the drill, that is to say, a good transport of drilling dust ensures good feed and prevents chatter marks in the drill hole and damage to the drill by jamming, overheating or the like. Jamming of the drill also involves danger of an accident to the operator. A large drilling dust transport groove with a corresponding configuration therefore ensures adequately good transport of drilling dust. This has a considerable influence on the useful life of the drilling tool.

The transport coil is also required to provide guidance characteristics in the drill hole to some extent.

In order to allow for adequate transport of the drilling dust, in known drills the transport groove cross-section is chosen so large that a ratio of diameters of the core diameter to the transport coil diameter of approximately 0.5 is obtained. Such a large transport groove cross-section to transport the drilling dust is necessary in the case of high capacity tools. However, a large transport groove cross-section has the disadvantage that the core of the transport coil is seriously weakened. When the drill locks, therefore, fractures always occur in the region of the core cross-section weakened by the transport groove. It is at least necessary to use very high-grade tool steel made of alloy steels in order to satisfy the strength requirements. The cross-section may be weakened additionally by core bores for coolant.

A drilling tool, also for use as a rock drill, tipped with a hard metal cutting edge, which has become known from German Pat. No. 6,933,778, consists of a rolled basic profile with two longitudinal ribs and its transport coil is produced by turning or twisting the basic profile. In a drilling tool of this type the ratio of coil diameter to the transport coil diameter is $>0.5$, as is otherwise customary for rock drills. However, due to its configuration the transport coil formed by the twisted longitudinal ribs exhibits unsatisfactory transport characteristics for the drilling dust. Accumulation and jamming are experienced particularly, due to the small transport groove cross-section. The drilling characteristics of such a tool are far inferior as regards drilling dust transport compared to the normal drilling tools. This also applies to the tools according to DIN 20,377, July 1979.

A certain minimum amount of free transport cross-section is therefore necessary in order to obtain satisfactory transport power of the drilling dust in the transport coil, and this generally leads to a weakening of the core diameter of the transport coil and consequently necessitates expensive initial materials in order to reduce the risk of fracture.

SUMMARY OF THE INVENTION

The underlying object of the invention is to produce a drilling tool, particularly a rock drill for percussive stressing, which avoids the above-mentioned disadvantages and which particularly exhibits equally good or improved transport characteristics for a smaller transport groove cross-section, that is to say, a larger core diameter or core cross-section.

This object is achieved according to the invention, starting from a rock drill of the type initially described, which includes a single-start or multiple start continuous and uninterrupted coil-shaped main transport groove with coil-shaped secondary transport grooves embedded therein and formed by transport ribs, while the main transport groove exhibits a steep pitch and a small angle of twist, and the secondary transport groove has a small pitch and a large angle of twist.

The invention starts from the discovery that an improvement in the transport characteristics of transport coils is only possible by structural measures within the transport groove. But if the transport characteristics of a transport groove can be improved so that a smaller transport cross-section for drilling dust is sufficient for the same transport quantity, then the core diameter and core cross-section of the transport coil can be constructed larger. The strength of the drill core in the region of the transport coil is improved by this means, that is to say the danger of fracture is reduced. An improvement or retention of the good transport characteristics in spite of a reduced transport groove cross-section also has the advantage that, due to the larger core diameter, it is possible to use a material with lower strength characteristics. A cheaper initial material can therefore be used for the production of the transport coil.

According to the invention the improvement or retention of the good transport characteristics, in spite of the reduction of the transport groove cross-section and resulting enlargement of the core cross-section, is achieved by the cooperation of a plurality of transport grooves. According to the invention, therefore, a continuous and uninterrupted main transport groove particularly is formed which cooperates with a secondary transport groove of smaller pitch. The secondary transport groove is formed by transport ribs which are located in the main transport groove. Due to the flatter pitch, that is to say a greater angle of twist, the secondary transport groove extends with smaller pitch than the main transport groove. This produces a constant additional relative movement of the drilling dust transported in the main transport groove, which leads to a loosening and therefore to better transport of the drilling dust in the main transport groove. Accordingly the transport capacity for transporting the drilling dust is considerably improved by the transport ribs of the secondary transport groove by regrouping and loosening the drilling dust, with the result that an otherwise inadequate transport groove cross-section which tends to clogging is nevertheless sufficient for an optimum transport of drilling dust. That is to say, the improved transport characteristics resulting from the cooperation of main transport groove and secondary transport groove permit optimum transport characteristics to be achieved even for a smaller transport groove cross-section. But the smaller transport groove cross-section permits a larger core cross-section of the transport coil, which contributes to increase the strength of the latter against possible fracture, or permits the use of lower strength material.

The transport characteristics are decisively improved overall by a cooperation of the main transport groove with transport ribs of the lower-pitch secondary transport groove located therebetween in between, which leads to a reduction of the transport groove cross-section and therefore to a more favourable ratio of core diameter to transport coil diameter.

As a further development of the invention, the boundary profiles or longitudinal profiles of the main transport groove and/or the interrupted transport ribs of the secondary transport groove exhibit suitable cross-sectional profiles, particularly a square, trapezoidal or circular cross-section. Any known profile may be adopted for the main transport groove. The nub of the invention therefore lies in the provision of a suitable continuous main transport groove with individual transport ribs to form a secondary transport groove.

According to a feature of the invention, the diameter of the secondary transport groove, which is formed by the transport ribs, is equal to or smaller than the diameter of the main transport groove which is formed by the longitudinal profiles. The correct proportion of the height of the secondary transport groove can be determined empirically in order to achieve the optimum transport effect with a small transport groove cross-section.

As a further development of the invention, the ratio of the core diameter to the diameter of the main transport groove is made approximately 0.8. Compared to the corresponding value of approximately 0.5 in conventional drills, this means a considerable strengthening of the core cross-section for equally good transport characteristics, because the diameter enlarges the cross-sectional area with the exponent 2 (square) ($F=\pi d^2/4$).

According to a further feature of the invention, the main transport groove and/or the secondary transport groove may be formed either by cutting or noncutting machining or by turning of a wing profile steel, as described in the introductory portion hereinabove.

According to the further development of the invention, the main transport groove is produced by applying and attaching a separate longitudinal profile in an appropriately made coil-shaped cavity. The production process can be simplified by this construction.

According to another feature of the invention, the secondary transport groove is formed by producing pocket-shaped cavities or recesses with the intervening transport ribs thus formed.

The widest variety of rib shapes for the secondary transport groove can be formed by this cutting shaping.

According to a further feature of the invention, the transport ribs of the secondary transport groove may exhibit different angles of twist, that is to say different pitch heights. The loosening of the material is effected by the ratio of the different pitches of the main transport groove and secondary transport groove and by different pitches of the secondary transport groove itself.

According to the a still further feature of the invention, the initial material used for the transport coil is a turned wing profile with longitudinal ribs which form a main transport groove, the transport ribs for the secondary transport groove are likewise rolled on as webs in the initial profile. However, it is possible for only a twisted wing profile to be used, the wings of which form the main transport groove and in which the transport ribs for the secondary transport groove have been made by cutting machining. A known profile rolled steel made to a standard set forth in DIN 488 Part 2 and 3, 6/86 forms a suitable initial material for a drilling tool with a main transport grooves and secondary transport groove.

If a material with low strength values is adopted as the transport coil, irrespective of whether the latter consists of a turned wing profile or of a milled solid material, the chucking shank for the hammer drill should be made of a higher grade material, and the joint between the different materials may be made by means of a friction welded joint or soldering or the like, for example.

In a further development of the invention according a central passage bore is made possible by the larger core cross-section. The transport of material can be further improved by a suction bore. The weight of the drill is also reduced. A particularly thick-walled tube may be used as initial material in this case.

According to additional advantageous features of the invention, a specially coordinated drill head permits optimum feeding of the drilling dust from the drill head to the drilling dust grooves by the association of cutter plate opposite the longitudinal profile or longitudinal ribs. The additional cutter pins in the region of the end face of the drill head ensure that the drilling dust occurs as a sufficiently fine substrate, so that it is transportable without obstruction in the flat drilling dust grooves.

Advantageous and convenient exemplary embodiments of the invention are illustrated in the drawings and explained more fully in the following description.

DETAILED DESCRIPTION OF THE PREFERRED EMBODIMENTS

Figure 1:
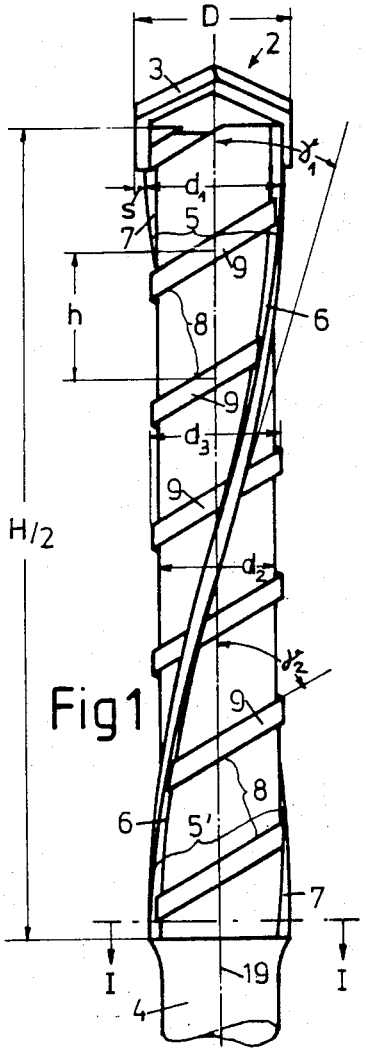
FIG. 1 shows a side elevation of a drill according to the invention.
Figure 2:
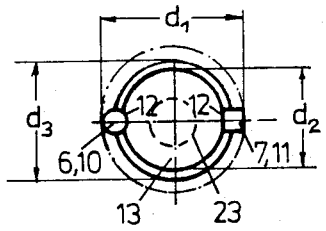
FIG. 2 shows a plan along the line of section I—I in FIG. 1 with variants of the main transport coil.

The rock drill illustrated in side elevation in FIG. 1 and in cross-section in FIG. 2 exhibits a transport coil (1), a drill head (2) with hard metal cutting element (3) and a chucking shank (4). The two-start transport coil (1) with cylindrical core cross-section (13) arranged between chucking shank (4) and drill head (2) consists of two main transport grooves (5, 5'), formed between two coil-shaped longitudinal profiles or ribs (6, 7). The main transport groove (5, 5') formed by the longitudinal profiles (6, 7) exhibits a small angle of twist $\gamma_1 \simeq$ which is in an approximate range of 15° to 25°, that is to say it has a relatively steep pitch. In the main transport groove (5, 5') a secondary transport groove (8) is embedded, incorporated or integrated, and which is defined or delimited by adjacent transport ribs (9), with a greater angle of twist $\gamma_2$ than the small angle of twist $\gamma_1$, and which is in a range between 30° to 80°, preferably 35°. The pitch of the secondary transport groove (8) is therefore considerably flatter than that of the main transport groove (5). This results in a plurality of transport ribs (9) which delimit the secondary transport groove (8). The secondary transport groove (8) is also delimited by the longitudinal ribs (6, 7) of the main transport groove (5), and continues in the second main transport groove (5'). Individual transport rib sections (9) are therefore formed. The secondary transport groove (8) may therefore be considered as a coil-shaped groove interrupted by the longitudinal profiles or ribs (6, 7).

In FIG. 1 the main transport groove (5) shown in elevation executes exactly half a pitch which is equal in length to H/2 as shown in FIG. 1. Approximately six transport rib sections (9) come to lie along this region. The pitch H of the main transport groove (5) is therefore in a ratio of 1:12 to a pitch h of the secondary transport groove (8). However, these values may vary.

A drill diameter D is determined by that of the hard metal cutting element (3). A diameter $d_1$ of the main transport groove (5) formed by the longitudinal profiles (6, 7) is somewhat smaller than the diameter D of the hard metal cutting edge (3). Here the hard metal cutting edge overhangs a distance s which is approximately in a range $s \simeq 0.3$ mm to 2 mm on each side. The core diameter $d_2$ of the cylindrical core of the transport coil (1) is in the following ratio to the diameter $d_1$ of the main transport groove (5) formed by the longitudinal profiles (6, 7): $d_2 : d_1 \simeq 0.8$. This shows that the free transport cross-section of the main transport groove is considerably smaller than for conventional drilling tools, where the ratio is approximately 0.5.

The diameter $d_3$ of the secondary transport groove (8) formed by the transport ribs (9) is somewhat smaller than the diameter $d_1$ of the longitudinal profiles (6, 7) and is between the values of $d_1$ and $d_2$.

In the exemplary embodiment according to FIG. 1, the drilling tool consists of a cylindrical core region (13) with machined or attached longitudinal profiles (6, 7) to form the main transport groove (5, 5') and transport ribs (9), likewise machined or attached, to form the secondary transport groove (8). For example, the secondary transport groove (8) with transport ribs (9) may be produced first of all with a flat pitch as a continuous initially uninterrupted transport coil (8). Then two coil-shaped cavities of recesses are made in the transport ribs 9 in the form of the longitudinal profiles (6, 7) to be inserted, which thereby divides the initially continuous coil-shaped secondary transport groove (8) with transport ribs (9) into individual transport rib section (9). As shown in an alternative embodiment in FIG. 2, the longitudinal profiles (6, 7) can have either a circular cross-section rib (10) or a square cross-section rib (11) or the like, and the ribs 10 and 11 are inserted into the cavity thus produced in the transport ribs 9 and attached therein by means of a soldered joint (12), for example. The cavity may extend into the core region (13) of the transport coil (1).

Accordingly, in FIG. 1 the two-start main transport groove (5, 5') for the drilling dust are formed between the longitudinal profiles (6, 7), which are constructed as inset members. This main transport groove (5, 5') is then subdivided into a plurality of secondary transport grooves (8) by the transport ribs (9). The relative movement of the drilling dust during transport in the transport coil (1) is obtained in this way.

In FIG. 1, and as shown in plan in FIG. 2, the core region (13) is of cylindrical construction.

Figure 3:
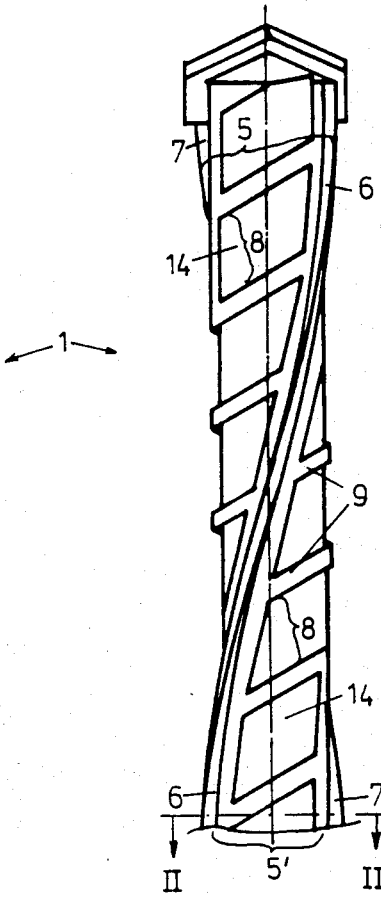
FIG. 3 shows an alternative embodiment of a drill in side elevation with milled pockets.
Figure 4:
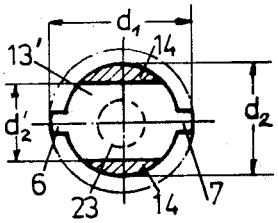
FIG. 4 shows a plan made along the line of section II—II.

As shown in FIG. 3, and in plan in FIG. 4, the core region of the main transport groove (5) may also exhibit different geometrical configurations. Thus the drilling tool in FIG. 3 consists, in schematic view, of an outline of an initially circular ummilled cylindrical wing profile (13') having the longitudinal profiles (6, 7) to form a two-start transport coil (1) with main transport grooves (5, 5'). The diameter formed by the longitudinal ribs (6, 7) is again indicated by $d_1$. In the exemplary embodiment according to FIGS. 3 and 4, the secondary transport grooves (8) with the transport ribs (9) are produced by milling away, for example, tangentially a part of the initially circular core region (13'), so that cavities or pockets (14) are formed. The transport ribs (9) and hence the secondary transport grooves (8) are formed here. The core diameter decreases to $d_2'$ in this region. The depth of the cavity (14) is dictated by the desired geometrical configuration. The cavity (14) is normally planar, however, in special cases it may also be made with a convex or concave curvature.

Figure 5:
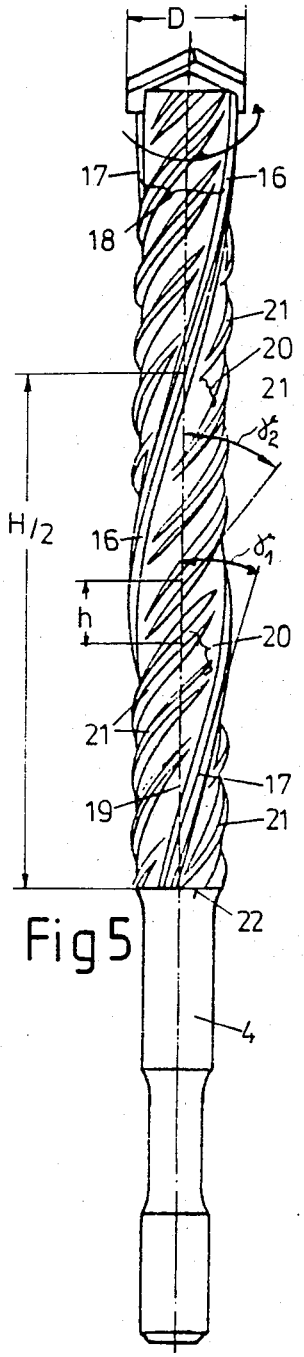
FIG. 5 shows a side elevation of a drilling tool made of a twisted initial material.
Figure 6:
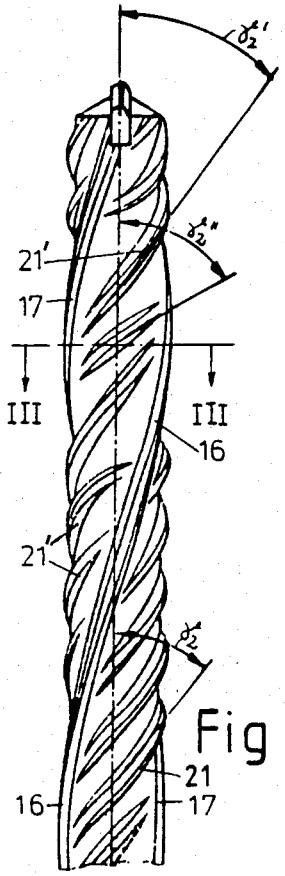
FIG. 6 shows a variation of FIG. 5 with different transport ribs.
Figure 7:
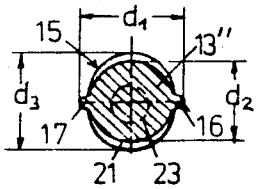
FIG. 7 shows a section made along the line of section III—III in FIG. 6.

In the case of the drilling tools shown in FIGS. 5 to 7, the initial material is a rolled and then turned or twisted circular cylindrical wing profile (15) with rolled longitudinal ribs (16, 17) to form a main transport groove (18). Before the turned state the longitudinal ribs (16, 17) are oriented parallel to the central drill axis (19). After the turning or twisting the longitudinal ribs (16, 17) shown in FIG. 5 are obtained to form the main transport groove (18).

In the exemplary embodiment according to FIG. 5 the secondary transport groove (20) is formed by the transport ribs (21) with the angle of twist $\gamma_2$ as previously described. The angle of twist of the main transport groove (18), formed by the longitudinal webs (16, 17), is designated $\gamma_1$. The transport ribs (21) to form the secondary transport groove (20) are already present in the initial profile as transverse webs between the longitudinal ribs (16, 17).

The half pitch H/2 of the main transport groove (18) and the interval h of the transport ribs (21) are also marked in FIG. 5. The ratio H: h is approximately 1:12.

The transport ribs (21) are built up similarly in cross-section to the longitudinal ribs (16, 17); these cross-sections are particularly trapezoidal. Each transport rib (21) extends between the two longitudinal ribs (16, 17), whilst the trapezium height of the cross-section of the transport ribs (21) decreases continuously towards zero towards the end regions. The transport ribs (21) consequently merge into the core surface of the groove at their extremity.

Another variation of the angle of twist $\gamma_2$ is provided in the exemplary embodiment according to FIG. 6. The angles of twist vary, as indicated at ribs 21, 21', and 21'', having respective angles $\gamma_2$, $\gamma_2'$, $\gamma_2''$, can thus assume different values for different ribs between 30° and 80°, whilst the respective angle of twist $\gamma_1$ of the main transport groove (18) is always smaller than the angle of twist $\gamma_2$ of the secondary transport groove. As a rule of thumb it may be assumed: $\gamma_2 \simeq 2 \times \gamma_1$. In FIG. 6 $\gamma_2 \simeq 35°$, $\gamma_2' \simeq 40°$ to 45°. Now if a third type of transport rib (21) is also provided, the angle is $\gamma 2''$ which is in the range of 60° to 65°. In this case the transport rib having the greatest angle of twist $\gamma_2''$ is arranged between the two transport ribs having the smaller angles of twist $\gamma_2$, $\gamma_2'$.

The configuration of the exemplary embodiments according to FIGS. 5 to 7 may be taken from DIN 488, part 2, 6/86, for example.

The chucking shank (4) shown in FIGS. 1 and 5 is fastened to the respective transport coil (1) by a friction welded joint (22), for examle. High grade tool steel is used as material for the chucking shank (4) in order to withstand the stresses in the hammer drill. Nonetheless, a material with lower strength characteristics, normal structural steel, for example, is sufficient as material for the transport coil (1) because the strength is increased for equal transport capacity by the cross-sectional enlargement of the core.

The underlying idea of the invention can therefore possibly be embodied with merely a transport coil made of conventional cold twisted profile rolled steel with longitudinal ribs and oblique ribs, as is known from DIN 488, Part 2 and 3, June ξedition. This is the more surprising because such low grade materials have been declared fundamentally unsuitable for use for such tools. It is therefore surprising that the low strength values of such a profile rolled steel can be adequate for use as a transport coil. Obviously, further measures in conformity with the development of the invention according to FIGS. 1 to 4 may be convenient in special cases.

A central bore or passage bore (23) as an alternative solution is shown by dash lines in FIGS. 2, 4 and 7. This bore may be used as a suction bore or coolant bore. It is also possible in this case to use a thick-walled tube as initial material for the transport coil.

As may be seen from FIGS. 1, 3, 5, 6 and FIG. 8, the drill exhibits a drill head (2) with a cutter plate (3) made of hard metal extending across the entire diameter D of the drill head (2). The cutter plate (3) is arranged so that it is aligned by its outer lower end (25) with the longitudinal profiles (6, 7) or the longitudinal ribs (16, 17), that is to say the longitudinal profiles (6, 7) or the longitudinal ribs (16, 17) merge smoothly into the laterally overhanging ends of the cutter element (3) in the region of the drill head. This may be seen from FIG. 6 by way of example.

Figure 8:
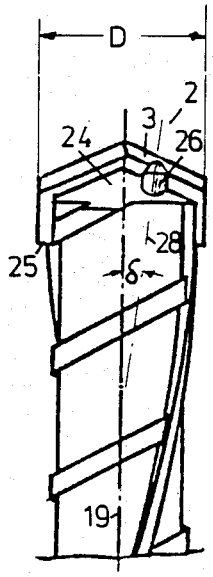
FIG. 8 shows a side elevation of a drill head and, FIG. 9 shows a plan of a preferred drill head.
Figure 9:
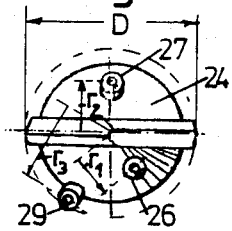

According to FIGS. 8 and 9 the preferred construction of the drill head further provides that cutter pins (26, 27) are arranged on the end face (24) of the drill head (2). These cutter pins (26, 27) may be arranged with their longitudinal axis (28) parallel or at an angle to the central drill axis (19).

The cutter pins (26, 27) may be distributed symmetrically (27) or asymmetrically (26) on the end face (24) of the drill head. The radial arrangement of the pins (26, 27) may also vary, that is to say the pin (26) is located in an inner radius $r_1$, the pin (27) on a larger radius $r_2$. In special cases a further cutter pin (29) may also be arranged on an extreme radius $r_3$ (see FIG. 9), whilst this extreme cutter pin (29) comes to lie virtually or on the diameter D formed by the cutter plate (3). (The cutter pin (29) is not shown in FIG. 8).

The cutter pins (26, 27, 29) made of hard metal considerably assist the drilling result, particularly as regards the grain fineness of the drilling dust. However, a finer drilling dust can be transported better in the grooves of small groove cross-section without causing any tendency to clog. The drill head constitutes an optimum amplification of the coil construction according to the invention in this respect.

The invention is not restricted to the exemplary embodiment illustrated and described. On the contrary, it also embraces all expert variations without inherent inventive content whilst realizing the principle according to the invention.

We claim:

1. Rock drill for rotary and percussive drilling operation, comprising:

a drill head having a hard metal cutting edge;

a chucking shank; and at least one transport coil having a substantially cylindrical core which has a longitudinal axis, a plurality of spiral-shaped longitudinal transport ribs extending a first predetermined distance from said cylindrical core, and a plurality of spiral-shaped secondary transport ribs extending from said cylindrical core a second predetermined distance which is smaller than said first predetermined distance, said secondary transport ribs connecting adjacent ones of said longitudinal transport ribs, adjacent ones of said plurality of longitudinal transport ribs respectively bounding main transport grooves, each of said main transport grooves being continuous and spiral-shaped along said cylindrical core, adjacent ones of said plurality of secondary transport ribs respectively bounding secondary transport grooves, each of said plurality of longitudinal transport ribs having a relatively steep pitch along said cylindrical core and consequently a relatively small angle of twist relative to said longitudinal axis, and each of said secondary transport ribs having a relatively small pitch and consequently a relatively large angle of twist relative to said longitudinal axis.

2. Drill according to claim 1, wherein at least one of (a) said longitudinal transport ribs and (b) said secondary transport ribs have a square cross-section.

3. Drill according to claim 1, wherein said longitudinal transport ribs have a first predetermined outer diameter and said secondary transport ribs have a second predetermined outer diameter which is smaller than said first predetermined diameter of said longitudinal transport ribs.

4. Drill according to claim 1, wherein said longitudinal transport ribs have a first predetermined diameter, said core has a predetermined core diameter, and the ratio of said core diameter to said first predetermined diameter of said longitudinal transport ribs is approximately 0.8.

5. Drill according to claim 1, wherein at least one of (a) said longitudinal transport grooves and (b) said secondary transport grooves are formed by machining of a profile steel.

6. Drill according to claim 1, wherein said longitudinal transport groove is formed by at least one helical cavity intersecting said continuous helical secondary transport groove a plurality of times, each of said longitudinal transport ribs comprising a member which is inserted in and secured to said cylindrical core.

7. Drill according to claim 1, wherein said secondary transport grooves are formed by a plurality of pocket-shaped cavities in said longitudinal transport grooves.

8. Drill according to claim 1, wherein said transport ribs of said secondary transport grooves are disposed at a plurality of different angles of twist.

9. Drill according to claim 1, wherein the ratio of (a) said angle of twist of each of said longitudinal transport grooves and of said longitudinal transport ribs to (b) said angle of twist of said secondary transport grooves and of said transport ribs, is in a range of approximately 1:2 to 1:3.

10. Drill according to claim 1, wherein the angle of twist of the longitudinal transport ribs is in a range of approximately 15° to 60°, and said angle of twist of said secondary transport ribs in a range of approximately 30° to 80°.

11. Drill according to claim 1, wherein, as initial material for said transport coil, a rolled and turned or twisted wing profile having at least one longitudinal rib can be used to form a helical longitudinal transport groove, and said initial profile includes webs which form said transport ribs of said helical secondary transport ribs.

12. Drill according to claim 1, wherein said transport coil is composed of structural steel or profile rolled steel and is connected by a friction welded joint to said chucking shank for use as a hammer drill, said chucking shank being composed of an alloy tool steel.

13. Drill according to claim 1, wherein said transport coil includes a central passage bore for use as a suction bore, said transport coil being formed from a tube.

14. Drill according to claim 1, wherein said drill head has a diameter and an end face which includes a cutter plate composed of hard metal extending across said diameter of said drill head, and said longitudinal transport ribs end directly in a outer lower region of said cutter plate and are aligned with an overhanging part of said cutter plate.

15. Drill according to claim 14, wherein, in addition to said cutter plate, said drill head includes on said end face a plurality of cutter pins composed of hard metal.

16. Drill according to claim 15, wherein said cutter pins are aligned with their respective longitudinal axes in a direction which is oblique to said longitudinal axis of said drill.

17. Drill according to claim 1, wherein at least one of (a) said longitudinal transport ribs and (b) said secondary transport ribs have a trapezoidal cross-section.

18. Drill according to claim 1, wherein at least one of (a) said longitudinal transport ribs and (b) said secondary transport ribs have a circular cross-section.

19. Drill according to claim 1, wherein at least one of (a) said longitudinal transport grooves and (b) said secondary transport grooves are formed by turning of a profile steel.

* * * * *